US005944225A

United States Patent [19]

Kawolics

[11] Patent Number: 5,944,225

[45] Date of Patent: Aug. 31, 1999

[54] INSULATED FAUCET FOR DISPENSING HOT LIQUIDS

[75] Inventor: Raymond P. Kawolics, Solon, Ohio

[73] Assignee: The Meyer Company, Cleveland, Ohio

[21] Appl. No.: 09/143,557

[22] Filed: Aug. 31, 1998

Related U.S. Application Data

[60] Provisional application No. 60/057,506, Sep. 4, 1997.

[51] Int. Cl.[6] ..... B67D 5/60

[52] U.S. Cl. ..... 222/131; 222/155; 137/375

[58] Field of Search ..... 222/155, 131, 222/556; 137/375, 558; 251/368, 144; 138/149

[56] References Cited

U.S. PATENT DOCUMENTS

| | | | |
|---|---|---|---|
| 259,698 | 6/1882 | Magin . | |
| 287,357 | 4/1883 | Babcock . | |
| 1,108,840 | 8/1914 | Franke . | |
| 1,499,562 | 7/1924 | Tampier . | |
| 1,668,635 | 5/1928 | Stefani . | |
| 2,019,478 | 11/1935 | Bueckermann . | |
| 2,182,749 | 12/1939 | Oestreicher . | |
| 2,331,729 | 10/1943 | Rice . | |
| 3,081,063 | 3/1963 | Seltsam . | |
| 3,402,731 | 9/1968 | Martin . | |
| 3,463,691 | 8/1969 | Martin . | |
| 3,520,325 | 7/1970 | Stuart . | |
| 3,724,491 | 4/1973 | Knudsen et al. . | |
| 3,998,240 | 12/1976 | Liautaud . | |
| 4,071,043 | 1/1978 | Carlson . | |
| 4,259,981 | 4/1981 | Busse . | |
| 4,314,580 | 2/1982 | Steinwand . | |
| 4,676,268 | 6/1987 | Sano . | |
| 4,884,596 | 12/1989 | Byers et al. | 137/375 X |
| 5,106,291 | 4/1992 | Gellert . | |
| 5,232,129 | 8/1993 | Guerra . | |
| 5,524,669 | 6/1996 | Trueb et al. . | |
| 5,685,328 | 11/1997 | Helmsderfer | 137/375 X |

*Primary Examiner*—Gregory L. Huson
*Attorney, Agent, or Firm*—Fay, Sharpe, Beall, Fagan, Minnich & McKee, LLP

[57] ABSTRACT

A faucet apparatus is provided for dispensing heated liquid from an urn interior. The faucet includes an insulated foamed plastic body made from foamed polypropylene or the like and has a liquid flow bore defined therein. The foamed plastic body has a plurality of gas-filled insulative bubbles dispersed through the walls thereof and is adapted for connection to an urn with the liquid flow bore in fluid communication with an interior portion of said urn. The faucet includes means connected to the body for controlling the flow of liquid through the bore to a liquid outlet of the faucet.

16 Claims, 4 Drawing Sheets

INSULATED FAUCET FOR DISPENSING HOT LIQUIDS

CROSS-REFERENCE TO RELATED APPLICATION

The present application claims priority from U.S. Provisional Patent Application Ser. No. 60/057,506, filed Sep. 4, 1997.

BACKGROUND OF THE INVENTION

The present invention relates to faucets, and more particularly to an insulated faucet for dispensing hot liquids from a heated or insulated urn or the like so that liquid trapped in the faucet for an extended period does not significantly cool.

A faucet connected to a heated or insulated urn for dispensing hot liquids such as coffee, tea, water, and the like, traps liquid between the urn and the faucet outlet in a shank portion of the faucet body. If no liquid is dispensed from the faucet for a period of time, the trapped liquid cools relative to the hot liquid in the urn. Thereafter, the next volume of liquid dispensed through the faucet is not sufficiently hot. The problem is aggravated by the fact that known faucets are manufactured from materials with high thermal conductivity such as brass or other metals, or are manufactured from plastic with a single, thin-walled structure.

An associated problem with known faucets is that the heat dissipated therethrough causes the faucet outer surface, especially in the shank region, to become dangerously hot. This can result in one being burned upon inadvertently touching of the shank.

Also, many known faucets include an uninsulated tubular glass sight gauge connected thereto to provide a user with an indication of the level of liquid remaining in the urn. The liquid trapped in the sight gauge also cools over time relative to the liquid in the urn, and these prior faucets do not include any means for limiting the flow of the cooled liquid from the sight gauge into the faucet when fluid is dispensed from the faucet. Accordingly, the liquid dispensed from the faucet is undesirably cooled.

SUMMARY OF THE INVENTION

In accordance with the present invention, a novel and non-obvious insulated faucet for dispensing hot liquids is provided.

In accordance with a first aspect of the present invention, a faucet apparatus for dispensing heated liquid from an urn interior includes an insulated foamed plastic body including at least one liquid flow bore defined therein. The foamed plastic body has a plurality of gas-filled insulative bubbles dispersed through the walls thereof and is adapted for connection to an urn with its liquid flow bore in fluid communication with the urn. The faucet includes means connected to the body for controlling the flow of liquid through the bore to a liquid outlet of the faucet.

In accordance with another aspect of the present invention, an apparatus for dispensing heated liquid includes an urn adapted for retaining heated liquid therein. An insulated plastic faucet projects outwardly from the urn and includes a bore defined therein in fluid communication with the urn. The faucet includes a body at least partially defined by an inner wall, an outer wall, and a plurality of separate gas-filled pockets between the inner and outer walls. The gas-filled pockets provide insulation for heated liquid trapped in the bore.

In accordance with still another aspect of the present invention, an insulated faucet for dispensing heated liquid includes a metallic faucet body including a head portion, a shank portion, and a bore formed through the head and shank portions. A valve seat is defined in the body and located in the bore, and valve means is provided for selectively blocking fluid flow through the bore. A foamed plastic insulating outer sleeve including a plurality of gas-filled bubbles therein covers at least substantially all of the shank portion of the metallic faucet body.

In accordance with another aspect of the invention, an insulated shank for a faucet includes a metallic shank having a first end adapted for selective attachment to an urn and a second end. The metallic shank includes a bore formed therethrough from the first end to the second end for connection in fluid communication with the urn. The insulated shank includes means for selectively attaching a faucet head to the second end of the shank with an outlet bore of the faucet head in fluid communication with the bore. A foamed plastic insulating sleeve is positioned in external covering relation with the metalic shank. The insulated shank also includes means for selectively securing the insulating sleeve to the shank.

One advantage of the present invention is found in the provision of an insulated faucet which limits cooling of liquid trapped therein.

Another advantage of the invention resides in the provision of an insulated faucet which does not become dangerously hot due to hot liquid trapped therein.

A further advantage of the present invention is the provision of a faucet including a sight gauge of smaller volume and made from a material of low thermal conductivity so that a minimum amount of liquid is trapped in the sight gauge and so that the liquid trapped in the sight gauge remains hot for a longer period of time.

Still another advantage of the present invention is the provision of an insulated faucet which limits the flow of liquid from the sight gauge into the faucet when liquid is dispensed from the faucet.

Another advantage of the present invention is found in the provision of an insulated faucet including a foamed plastic body including a plurality of gas-filled bubble dispersed therethrough.

A yet further advantage of the present invention is the provision of a gas-assist injection molded faucet body including a plurality of insulative gas-filled pockets therein.

Another advantage of the present invention is found in the provision of a faucet with a metallic faucet body including a selectively attached foamed plastic insulating sleeve.

Still other objects, features, and advantages of the present invention will become apparent to those of ordinary skill in the art upon reading and understanding the present application in conjunction with the drawings.

BRIEF DESCRIPTION OF THE DRAWINGS

The invention may take physical form in certain parts and arrangements of parts, preferred embodiments of which are described in detail herein and illustrated in the accompanying drawings which form a part hereof and wherein.

DETAILED DESCRIPTION OF THE PREFERRED EMBODIMENTS

Figure 1:
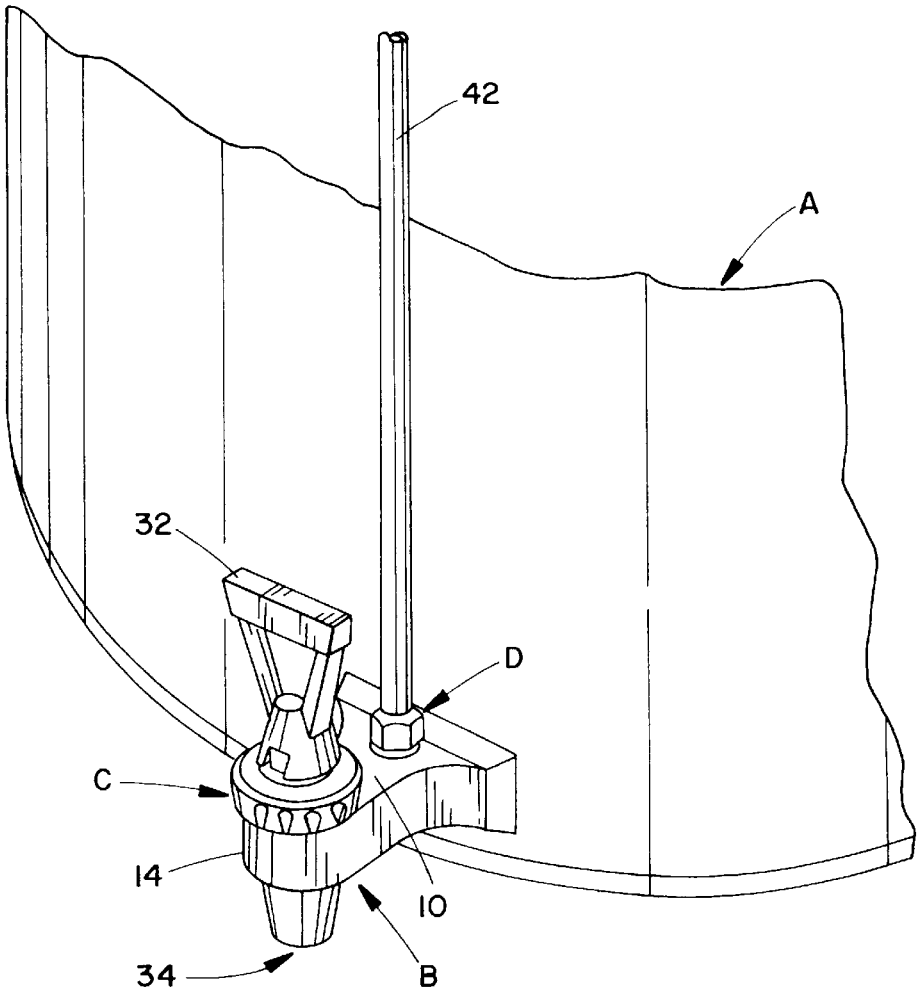
FIG. 1 is a partial perspective view of an urn and associated insulated faucet for dispensing hot liquids in accordance with the present invention.

FIG. 1 illustrates an insulated or heated urn A for dispensing hot liquids such as coffee or the like.

Figure 2:
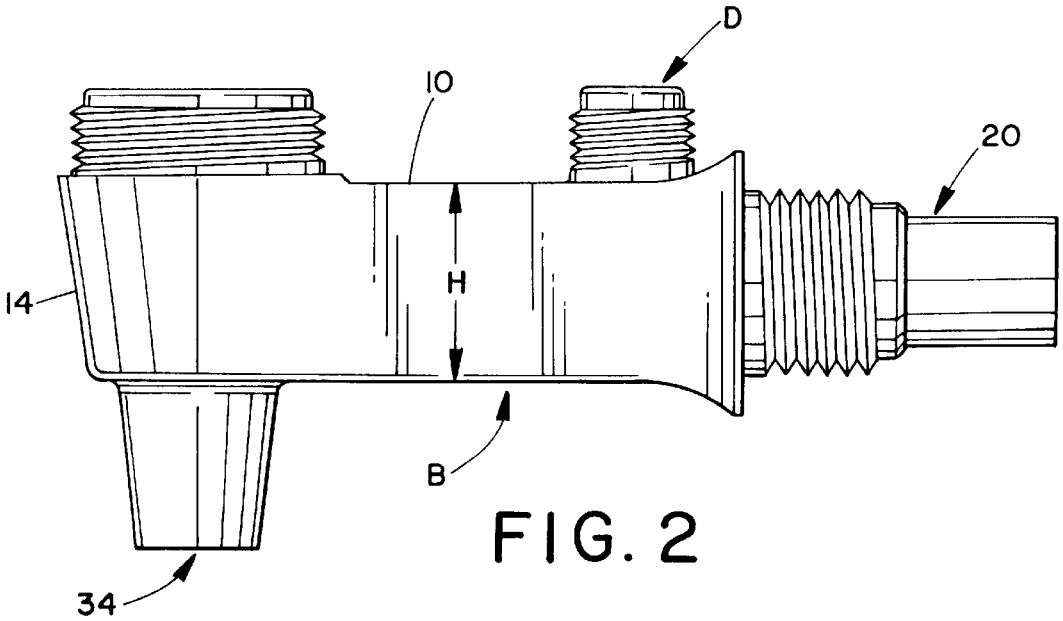
FIG. 2 is a side elevational view of the insulated faucet body of FIG. 1 formed in accordance with the present invention.
Figure 4:
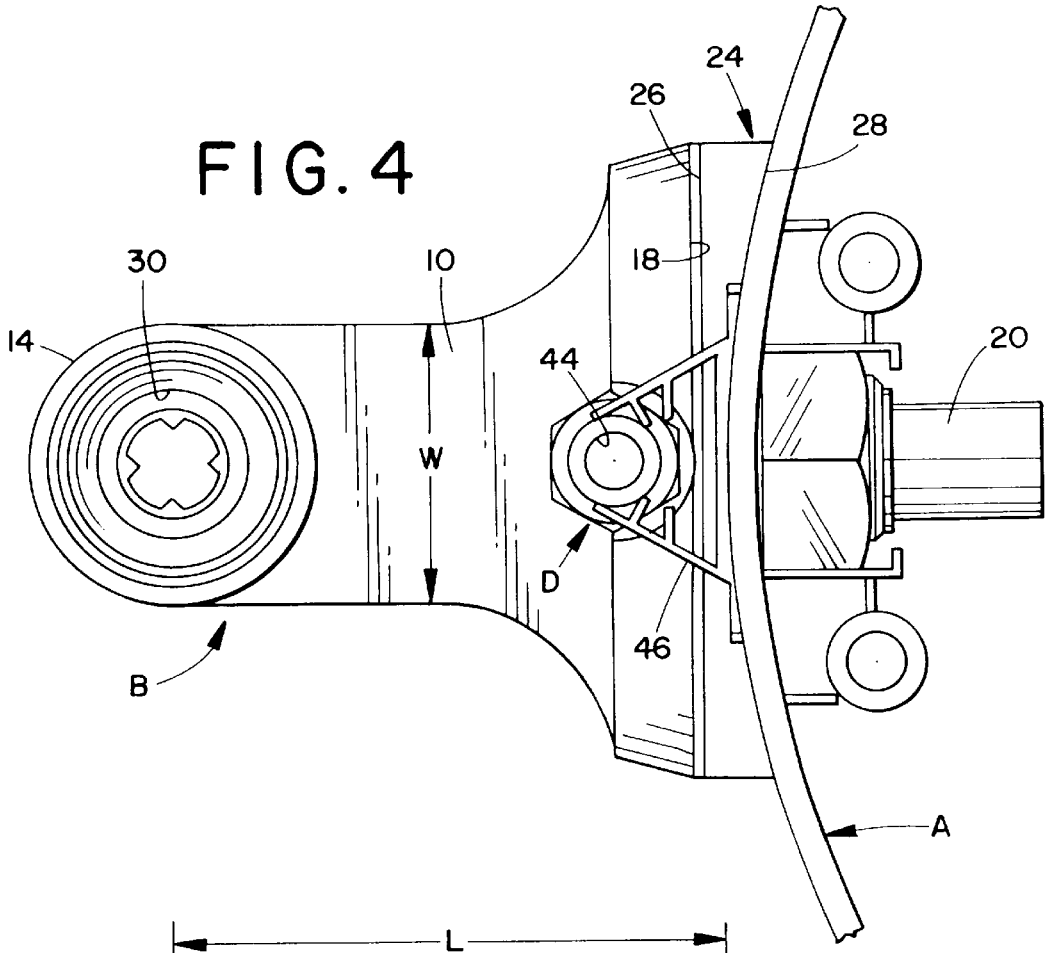
FIG. 4 is a top plan view of the insulated faucet of FIG. 2.
Figure 3:
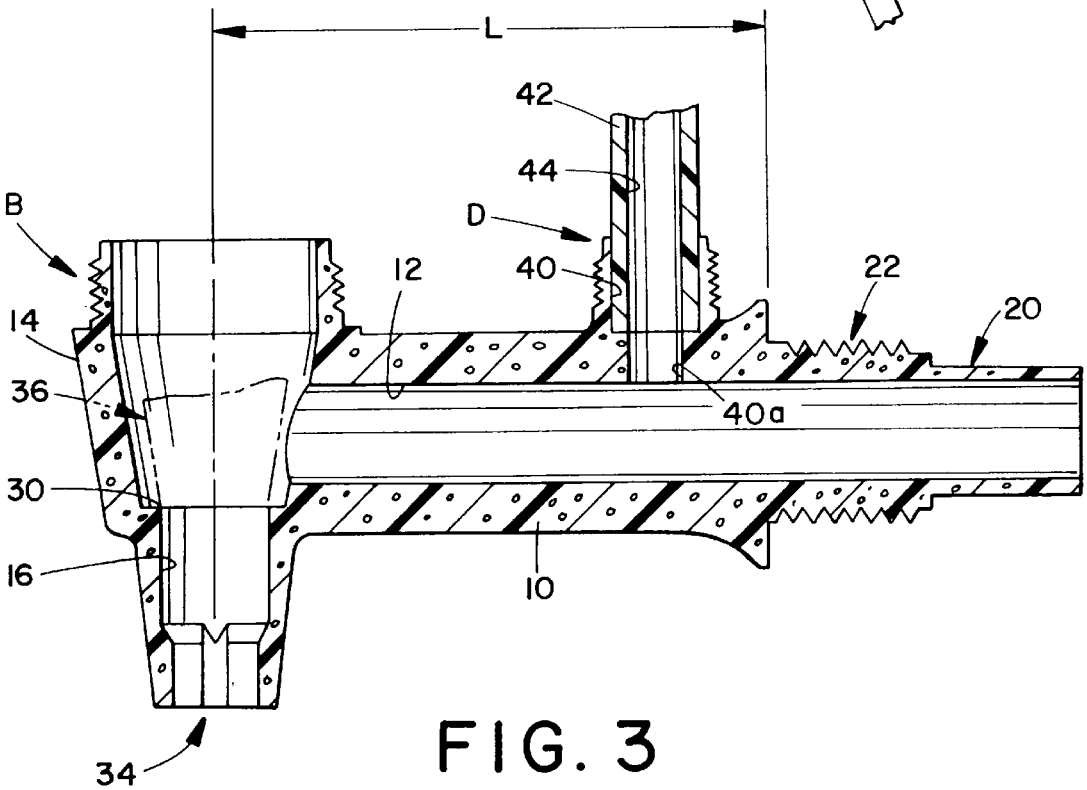
FIG. 3 is an axial cross-sectional view of the faucet body of FIG. 2.

The hot liquid in the interior of the urn A is dispensed through a faucet B into a cup or other suitable container, typically for direct human consumption. With reference also to FIGS. 2–4, the faucet B includes a body comprising a shank portion 10 having a liquid flow bore 12 (FIG. 3) formed therethrough and a faucet head portion 14 having an outlet bore 16 formed therethrough and in fluid communication with the shank bore 12. A first end 20 of the shank 10 is connected to the urn A by threads 22 or other suitable means so that the bore 12 is in fluid communication with a liquid outlet of the urn A and receives hot liquid therefrom. The threads 22 may be male or female, and may also be metal "insert" threads, i.e., metal threads molded into the plastic shank 10. An spacer or insert member 24 (FIG. 4) is positioned between the shank 10 and the urn A. The insert 24 includes a first or outer surface 26 that conforms with an inner face 18 of the shank 10 (preferably a planar surface), and a second or inner surface 28 that is curved or otherwise shaped to conform with an outer surface of the urn A.

With reference to FIGS. 1 and 3, a valve actuator or bonnet assembly C is threadably secured to the faucet head 14 and includes a valve seat cup 36 made of a resilient polymer (only partially shown in broken lines for clarity) or other valve control means operatively connected thereto for selectively mating with a valve seat 30 defined in the faucet head 14 by a reduced diameter portion of the bore 16 to control the flow of liquid into the outlet bore 16 from the shank bore 12. The bonnet C includes a valve actuator handle 32 by which a user controls the position of the seat cup 36, or other valve means, relative to the valve seat 30 and, thus, the flow of liquid from the shank bore 12 into the outlet bore 16 and through the valve outlet 34. Details of one suitable valve actuator/bonnet assembly may be found in U.S. Pat. No. 3,081,063, the disclosure of which is expressly incorporated by reference herein.

As shown herein, the faucet B also includes a sight gauge attachment portion D including a bore 40 in communication with the bore 12 defined in the shank 10. An elongated tubular and transparent sight gauge 42 is connected in communication with the bore 40 so that liquid flows into and is maintained in the gauge 42 to a level that corresponds to the level of liquid in the urn A.

With continuing reference to FIG. 3, it can be seen that a volume of liquid will be trapped in the shank bore 12, between the end 20 attached to the urn A and the valve seat 30. To prevent this trapped liquid from cooling during periods when no liquid is dispensed through the faucet B, at least the shank portion 10 of the faucet B is manufactured from a material with low thermal conductivity. Further, at least the shank portion 10 of the faucet B is constructed to have a thick-walled structure. Preferably, as shown herein, the faucet B is molded or otherwise formed from foamed polypropylene using a ⅓ percent (⅓%) mix of a suitable foaming agent, such as ActiveX, an endothermic foaming agent available commercially from the J.M. Huber Corporation. Of course, those of ordinary skill in the art will recognize that plastics other than polypropylene and/or other foaming agents/methods may be used to form the faucet B, and it is not intended that the invention be limited to use of any particular plastic and/or foaming agent/method. The foamed plastic faucet structure advantageously includes numerous gas bubbles dispersed throughout which provide the faucet with superior insulative properties. For example, with a shank bore 12 having a diameter of approximately 0.45 inches, the shank preferably has a height H of at least approximately 0.8 inches–1.0 inches and a width W of at least approximately 1.0 inch to 1.5 inches. Most preferably, the height H is approximately 0.85 inches and the width W is approximately 1.25 inches. Therefore, even after hot liquid remains trapped in the shank bore 12 for an extended period of time, it. does not significantly cool relative to the liquid in the urn A. Thus, even the first cup of coffee or volume of other liquid dispensed after periods of inactivity is sufficiently hot. The foamed plastic insulated faucet B not only keeps liquid trapped in the bore 12 hot, but also prevents the outer surface of the faucet B from becoming dangerously hot due to the presence of hot liquid trapped in the shank bore 12. This prevents one from being burned upon contact with the faucet B.

To further decrease the potential for liquid to cool in the shank bore 12, the shank 10 is preferably shortened relative to conventional faucet shanks. In one example, the shank 10 has a length L (FIG. 3) extending from its inner face 18 to the center of the outlet bore 16 of approximately 2 inches to 2.5 inches or less, and most preferably approximately 2.3 inches to 2.4 inches. As such, the volume of liquid trapped in the shank bore 12 is reduced relative to known faucets, without reducing liquid flow rates.

Similarly, with the present invention, the volume of liquid contained in the sight gauge 42 is also minimized. However, rather than shortening the length thereof, which would limit its effectiveness, the diameter of the sight gauge bore 44 is reduced from the conventional 0.75 inches to less than 0.5 inches, and most preferably is approximately 0.375 inches, which has been found most desirable for allowing proper sight gauge operation while significantly reducing the volume of liquid trapped in the bore 44, Furthermore, rather than use conventional glass tubing for the sight gauge 42, a lower thermal conductivity clear polycarbonate plastic tubing is preferably used to reduce thermal losses through the gauge 42. Also, the bore 40 formed through the gauge attachment portion D includes a reduced diameter portion 40*a*, which is formed directly in the shank 10 or provided by a washer insert or other means for limiting the flow of liquid from the gauge 42 (where it may have cooled over time) into the shank bore 12 when liquid is dispensed through the faucet outlet 34. The sight gauge preferably includes a gauge shield 46 of extruded. plastic as is described in full detail in commonly owned and co-pending U.S. application Ser. No. 09/143,771 (Attorney Docket No. TOM 2 404), filed together and on even date herewith by U.S. Express Mail, and entitled "Shield for a Sight Gauge," the disclosure of which co-pending application is expressly incorporated by reference herein.

Figure 5:
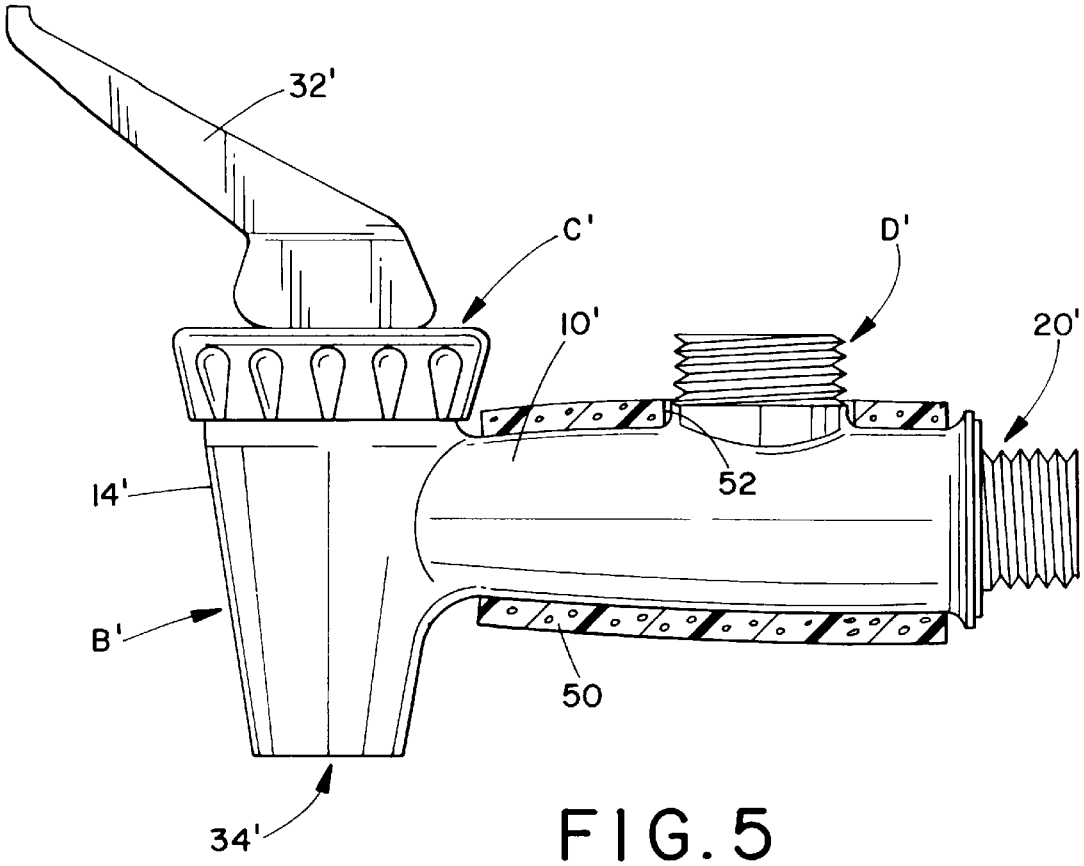
FIG. 5 is a side elevational view of a second embodiment of an insulated faucet in accordance with the present invention, including an insulating faucet jacket shown in cross-section.

A second embodiment of an insulated faucet in accordance with the present invention is shown in FIG. 5. For ease of understanding, like components relative to the faucet B are shown with like reference numerals including a primed (') suffix. The faucet B' is similar in all respects with the faucet B, except the body of the faucet B', including the shank 10' and faucet head 14', are made from a conventional material such as brass or other metal. However, to insulate the faucet body, an insulating sleeve 50 (shown in cross-section) of foam or other suitable insulation material is telescoped or otherwise positioned to cover at least a substantial portion if the shank 10'. The sleeve 50 includes a lateral hole 52 to accommodate the sight gauge attachment portion D' of the faucet B'.

Figure 6:
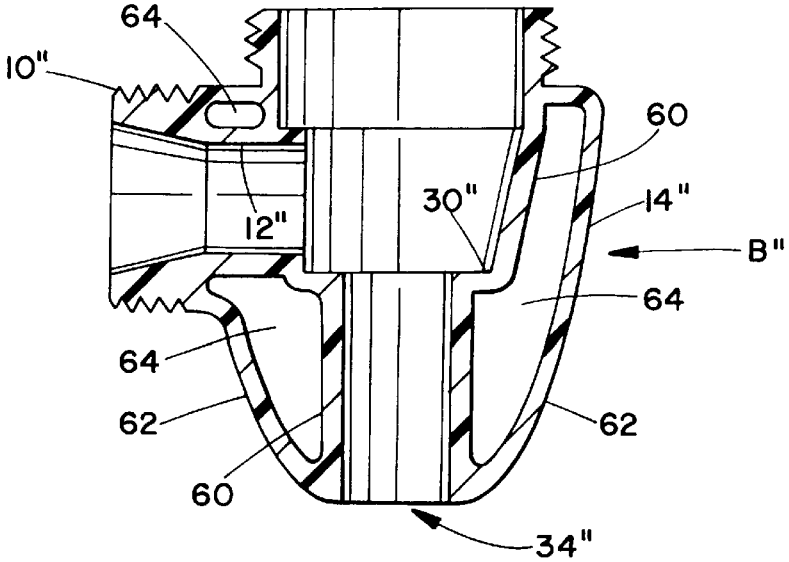
FIG. 6 is a cross-sectional view of an insulated faucet in accordance with a third embodiment of the present invention; and, FIG. 7 is a cross-sectional view of an insulated shank portion of a fourth faucet embodiment in accordance with the present invention.

A third embodiment of an insulated faucet in accordance with the present invention is shown in FIG. 6. For ease of understanding, like components relative to the faucet B are shown with like reference numerals including a double-primed (") suffix. The body of the faucet B", including the shank 10" and the head 14", is formed of double-walled injection molded plastic. Preferably, the faucet B" is formed through a gas-assisted injection molding process wherein an inner wall 60 and an outer wall 62 of the faucet body B" define a plurality of gas containing pockets 64 therebetween which insulate the shank 10" and head 14" of the faucet B". Although as shown herein, the shank 10" is shortened relative to the faucets B,B', those skilled in the art will recognize that the shank 10" can be any desired length.

Figure 7:
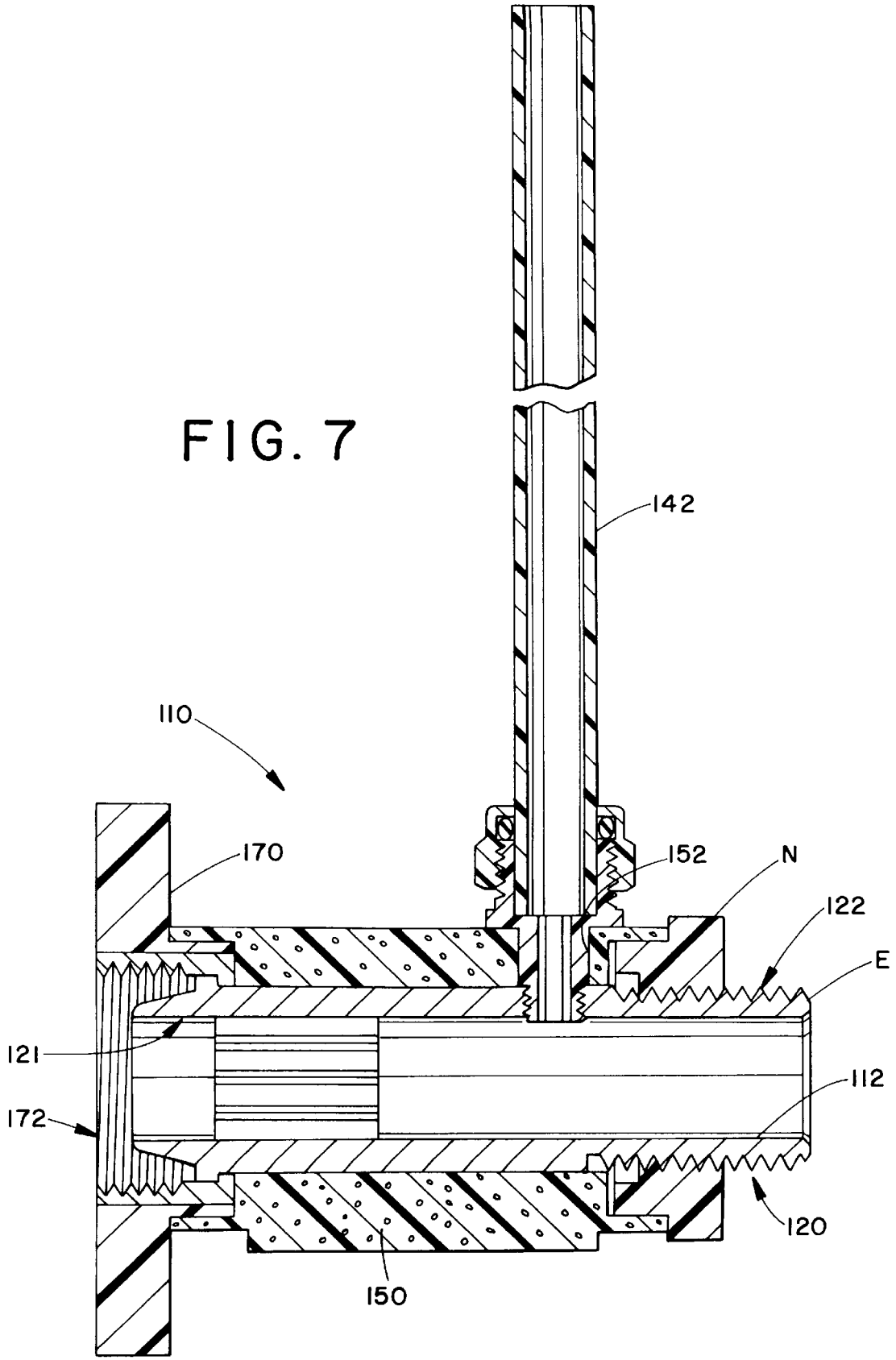

FIG. 7 illustrates another alternative faucet shank 110 in accordance with the present invention. Like parts relative to the shank 10 and 10' are referenced with numbers which are 100 greater than the corresponding parts in FIGS. 1–5. A shank body E, made from brass or another suitable metal or material includes a bore 112 formed therethrough from an end 120 to an end 121 to receive liquid, at the end 120, from an urn A. A faucet head attachment member, such as a wing-nut 170 is secured to the end 121 of the shank body E, but is free to rotate relative thereto The member 170 includes threads 172 or other suitable means for mating in fluid communication with any suitable faucet head (not shown).

An insulating sleeve 150, preferably made from a foamed plastic as described above, is telescoped over or otherwise placed in covering relation with the shank body E and axially secured in position with a nut N. The nut N is partially overlapped by the sleeve 150 so that the axial position of the nut N on the threads 122 is adjustable, preferably 0.25 to 0.5 inches, without exposing any portion of the shank body E to the surrounding atmosphere. Likewise, the partial overlap of the sleeve 150 and the nut 170 allows for limited axial movement of the sleeve 150 without exposing any portion of the shank body E to the surrounding atmosphere.

The sleeve 150 is provided either with or without a lateral hole 152 formed therethrough to accommodate a sight gauge 142 and its associated structure.

The invention has been described with reference to preferred embodiments. Of course, modifications and alterations will occur to others upon reading and understanding the preceding specification. It is intended that the invention be construed as including all such modifications and alterations insofar as they fall within the scope of the following claims.

Having thus described the preferred embodiments, what is claimed is:

1. A faucet apparatus for dispensing heated liquid from an urn interior, said faucet comprising:

an insulated foamed plastic body including at least one liquid flow bore defined therein, said foamed plastic body having a plurality of gas-filled insulative bubbles dispersed through walls thereof and adapted for connection to an urn with said at least one liquid flow bore in fluid communication with an interior portion of said urn;

means connected to said body for controlling the flow of liquid through said at least one bore to a liquid outlet of said faucet.

2. The faucet as set forth in claim 1 wherein said foamed plastic body is defined to include:

a foamed plastic faucet head having a liquid outlet bore defined therein; and, a foamed plastic shank connected to said faucet head and extending outwardly therefrom, said shank including a first end adapted for connection to said urn and a liquid flow bore defined therein for fluidically connecting said interior portion of said urn to said liquid outlet bore defined in said faucet head.

3. The faucet as set forth in claim 2 wherein said liquid outlet bore is defined in said foamed plastic faucet head to include a reduced diameter portion defining a valve seat, and wherein said fluid flow control means includes a seat cup that selectively mates in fluid-tight relation to block fluid flow through said liquid outlet bore to said faucet outlet.

4. The faucet apparatus as set forth in claim 2 further comprising:

a plastic tubular sight gauge including a central bore, said gauge extending vertically upward from said foamed plastic shank and with said central bore of said gauge in fluid communication with said fluid flow bore defined in said shank;

a sight gauge shield at least partially surrounding and securing said plastic tubular sight gauge in a fixed relationship with said shank.

5. The faucet as set forth in claim 4 wherein said plastic tubular sight gauge comprises clear polycarbonate plastic tubing having said central bore defined therein with a diameter in the range of 0.375–0.5 inches.

6. The faucet as set forth in claim 4 further comprising:

means for limiting the flow of liquid from the central bore of the plastic tubular sight gauge into the fluid flow bore defined in the shank when liquid is dispensed from said liquid outlet of said faucet.

7. The faucet as set forth in claim 2 further comprising:

an insert spacer member adapted for selective positioning between said foamed plastic faucet body and a curved outer surface of said urn, said insert spacer member including: (i) a planar outer-facing surface adapted for lying adjacent a planar inner-facing surface of the body; and, (ii) a curved inner-facing surface adapted for lying adjacent said curved outer surface of said urn.

8. The faucet as set forth in claim 1 wherein said insulated faucet body comprises foamed polypropylene.

9. The faucet as set forth in claim 2 wherein said foamed plastic insulated body comprises polypropylene foamed with an endothermic foaming agent so that said body includes a plurality of gas bubbles dispersed therein.

10. An apparatus for dispensing heated liquid, said apparatus comprising:

an urn adapted for retaining heated liquid therein;

an insulated plastic faucet projecting outwardly from said urn and including a bore defined therein in fluid communication, with said urn, said faucet comprising a body at least partially defined by an inner wall, an outer wall, and a plurality of separate gas-filled pockets defined between said inner and outer walls, each of said gas-filled pockets providing insulation for heated liquid trapped in said bore.

11. The heated liquid dispensing apparatus as set forth in claim 10 wherein said plastic body is formed from gas-assisted injection molded plastic.

12. The apparatus for dispensing heated liquid as set forth in claim 11 further comprising:

a valve assembly including:

a flow-control member for selectively mating in fluid-tight relation with a valve seat defined by a reduced diameter portion of said bore; and, means for selectively moving said flow-control member away from said valve seat to allow fluid flow through said bore past said valve seat and flow-control member.

13. An insulated faucet for dispensing heated liquid, said insulated faucet comprising:

a metallic faucet body including a head portion, a shank/portion, and a bore formed through said head and shank portions;

a valve seat defined in said body and located in said bore;

valve means for selectively blocking fluid flow through the bore; and, a foamed plastic insulating outer sleeve including a plurality of gas-filled bubbles therein covering at least substantially all of said shank portion of said metallic faucet body.

14. The insulated faucet for dispensing heated liquid as set forth in claim 13 wherein said foamed insulating plastic outer sleeve is defined from foamed polypropylene.

15. An insulated shank for a faucet comprising:

a metallic shank including a first end adpated for selective attachment to an urn and a second end, said metallic shank including a bore formed therethrough from the first end to the second end for connection in fluid communication with the urn;

means for selectively attaching a faucet head to said second end of said shank with an outlet bore of said faucet head in fluid communication with said bore formed through said shank;

a foamed plastic insulating sleeve positioned in external covering relation with said metallic shank; and, means for selectively securing the insulating sleeve to the shank.

16. The insulated shank for a faucet as set forth in claim 15 wherein said means for selectively securing the insulating sleeve comprises:

a nut threadably secured to said first end of said metallic shank and selectively advanceable on said body toward said body second end so that said insulating sleeve is trapped between said faucet head attachment means and said nut, said nut and said insulating sleeve partially overlapping so that said nut and sleeve together insulate said shank.

* * * * *